US008727020B2

(12) United States Patent
Bertrand

(10) Patent No.: US 8,727,020 B2
(45) Date of Patent: May 20, 2014

(54) FRAC ADAPTER FOR WELLHEAD

(75) Inventor: Bradley Bertrand, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 294 days.

(21) Appl. No.: 12/937,525

(22) PCT Filed: Apr. 29, 2009

(86) PCT No.: PCT/US2009/042039

§ 371 (c)(1),
(2), (4) Date: Oct. 12, 2010

(87) PCT Pub. No.: WO2009/154881

PCT Pub. Date: Dec. 23, 2009

(65) Prior Publication Data

US 2011/0083852 A1 Apr. 14, 2011

Related U.S. Application Data

(60) Provisional application No. 61/074,090, filed on Jun. 19, 2008.

(51) Int. Cl.
*E21B 33/038* (2006.01)
*E21B 33/04* (2006.01)

(52) U.S. Cl.
USPC ..... 166/379; 166/75.13; 166/378

(58) Field of Classification Search
USPC ..... 166/368, 378, 379, 75.13
See application file for complete search history.

(56) References Cited

U.S. PATENT DOCUMENTS

| | | | | |
|---|---|---|---|---|
| 5,490,565 | A | 2/1996 | Baker | |
| 5,615,739 | A * | 4/1997 | Dallas | 166/306 |
| 6,695,064 | B2 | 2/2004 | Dallas | |
| 6,817,423 | B2 | 11/2004 | Dallas | |
| 7,066,269 | B2 * | 6/2006 | Dallas et al. | 166/379 |
| 2003/0111271 | A1 | 6/2003 | Dallas | |
| 2003/0205385 | A1 * | 11/2003 | Duhn et al. | 166/380 |
| 2003/0221838 | A1 | 12/2003 | Dallas | |
| 2009/0211749 | A1 * | 8/2009 | Nguyen et al. | 166/75.11 |
| 2011/0162852 | A1 * | 7/2011 | Nguyen et al. | 166/378 |

FOREIGN PATENT DOCUMENTS

CA 2632646 4/2008

OTHER PUBLICATIONS

Cameron; Drilling and Production Systems; Products and Services Overview; www.c-a-m.com; Printed in USA, Nov. 2006, TC9511.
Cooper Cameron; TransactInsider; www.coopercameron.com/content/company/insider/insider36.htm; Issue 36; Mar. 28, 2005.

(Continued)

*Primary Examiner* — Giovanna Wright
(74) *Attorney, Agent, or Firm* — Fletcher Yoder, P.C.

(57) ABSTRACT

There is provided a frac adapter configured to couple a frac tree to a wellhead component. The frac adapter may couple the frac tree to a casing head without a tubing head, thereby enabling the well to be fractured before the tubing head is installed. As a result, the tubing head used in well production may be pressure-rated for production pressures rather than for fracing pressures. The frac adapter may be coupled to or integral with the frac tree. In addition, a union-nut coupling may be employed to quickly and easily assemble and disassemble the frac adapter from the wellhead component, such as the casing head. The union-nut coupling may further enable the components to be pressure-tested before the fracturing process is initiated.

14 Claims, 4 Drawing Sheets

(56) References Cited

OTHER PUBLICATIONS

T3 Energy Services; Wellhead and Production Systems; Surface Wellhead and Equipment Catalog; www.t3energy.com; 2009.

PCT Search Report and Written Opinion of PCT Application No. PCT/US2009/042039 mailed Aug. 21, 2009.

Weatherford Transformer Wellhead Sytem; 2008 Weatherford.

Singapore Search Report and Written Opinion for Singapore Application No. 201008492-9 dated Nov. 11, 2011.

* cited by examiner

FRAC ADAPTER FOR WELLHEAD

CROSS-REFERENCE TO RELATED APPLICATIONS

This application claims priority to and benefit of PCT Patent Application No. PCT/US2009/042039, entitled "FRAC ADAPTER FOR WELLHEAD," filed on Apr. 29, 2009, which is herein incorporated by reference in its entirety, and which claims priority to and benefit of U.S. Provisional Patent Application No. 61/074,090, entitled "FRAC ADAPTER FOR WELLHEAD", filed on Jun. 19, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract fluids, such as oil, gas, and water, from subterranean reserves. These fluids, however, are often expensive to extract because they naturally flow relatively slowly to the well bore. Frequently, a substantial portion of the fluid is separated from the well by bodies of rock and other solid materials and may be located in isolated cracks within a formation. These solid formations impede fluid flow to the well and tend to reduce the well's rate of production.

This effect, however, can be mitigated with certain well-enhancement techniques. Well output often can be boosted by hydraulically fracturing the rock disposed near the bottom of the well, using a process referred to as "fracing." To frac a well, a fracturing fluid is pumped into the well until the down-hole pressure rises, causing cracks to form in the surrounding rock. The fracturing fluid flows into the cracks, causing the cracks to propagate away from the well and toward more distant fluid reserves. To impede the cracks from closing after the fracing pressure is removed, the fracturing fluid typically carries a substance referred to as a proppant. The proppant is typically a solid, permeable material, such as sand, that remains in the cracks and holds them at least partially open after the fracturing pressure is released. The resulting porous passages provide a lower-resistance path for the extracted fluid to flow to the well bore, increasing the well's rate of production.

Fracing a well often produces pressures in the well that are greater than the pressure-rating of certain well components. For example, some fracing operations, which are temporary procedures and encompass a small duration of a well's life, can produce pressures that are greater than 10,000 psi. In contrast, pressures naturally arising from the extracted fluid during the vast majority of the well's life may be less than 5,000 psi. Wellhead equipment rated for 10,000 psi may be much more costly to purchase and operate than wellhead equipment rated for 5,000 psi. However, for safety reasons, the equipment is purchased based on the highest pressure rating required during the life of the well.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

Figure 1:
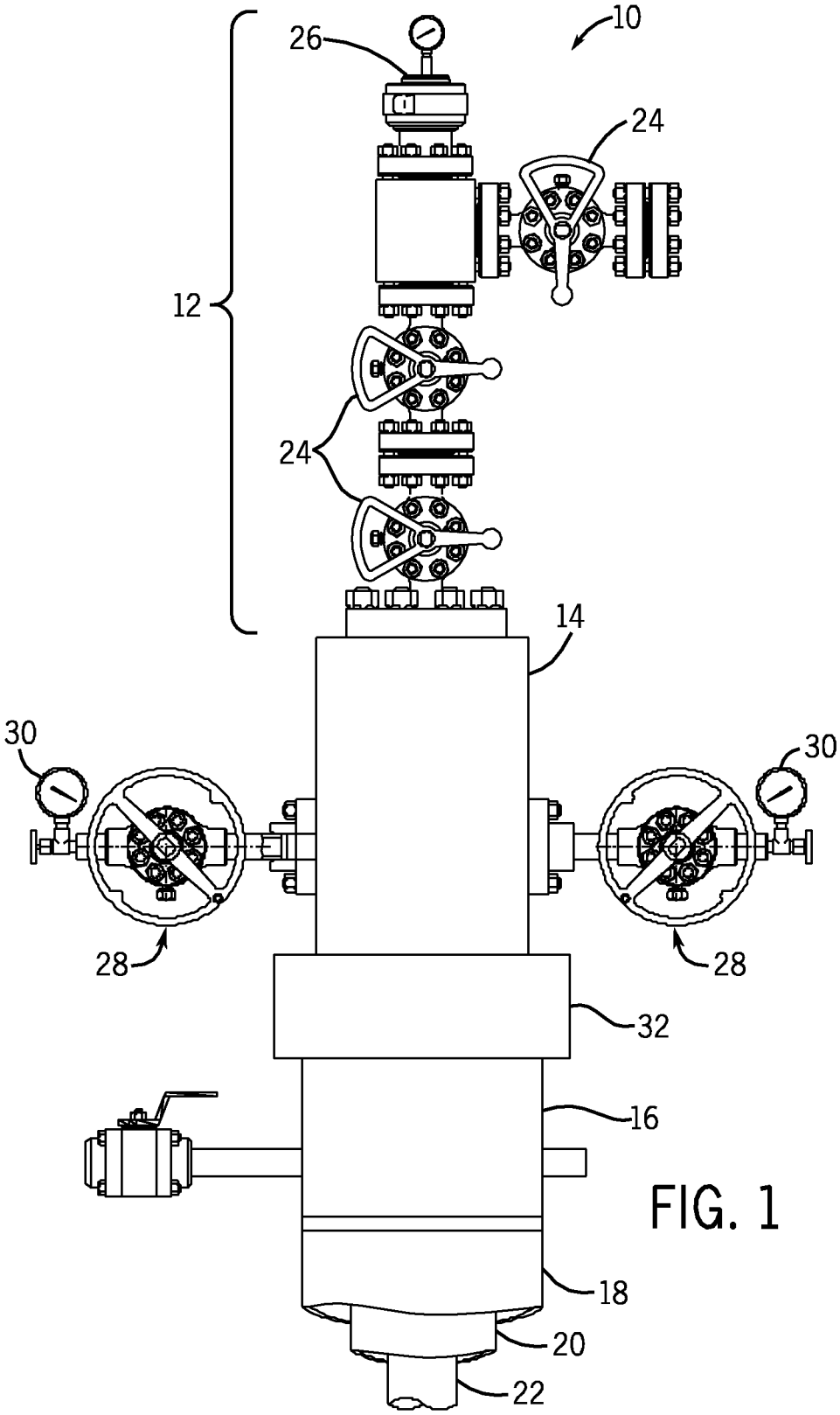
FIG. 1 is a side view of an embodiment of a wellhead having a production tree attached thereto.

FIG. 1 illustrates an embodiment of a wellhead assembly 10. In this embodiment, the wellhead assembly 10 is a surface wellhead, but other embodiments may include a subsea wellhead. The wellhead assembly 10 is configured to extract oil or gas, but other embodiments may be configured to extract other materials, such as water. Furthermore, some embodiments may be configured to inject materials, such as steam, carbon dioxide, or various other chemicals. The illustrated wellhead assembly 10 includes a tree 12, a tubing head 14 (also referred to as a "tubing spool"), a casing head 16, a conductor pipe 18, a surface casing 20, and a production casing 22, although other and/or additional equipment may be installed on the wellhead assembly 10. The tree 12 may be, for example, a production tree. A plurality of valves 24 in the tree 12 may control fluid flow to or from the production casing 22. The tree 12 also includes an inlet 26 through which equipment may be lowered into and removed from the wellhead assembly 10. The tubing head 14 includes side valves 28 and pressure gauges 30. The wellhead assembly 10 may be a Cameron International Corporation (Houston, Tex.) Time Saver wellhead, which includes a union-nut coupling 32 that secures the tubing head 14 and the casing head 16 to one another. During production, fluids may be pumped to and from a mineral deposit via the production tree 12. Fluid flow through the conductor pipe 18 and the casings 20 and 22 may be controlled by the various valves 24 and 28 on the tree 12 and the tubing head 14.

As discussed above, in order to fracture the mineral formation under the exemplary wellhead assembly 10, fracturing fluid may be pumped through the wellhead assembly 10 at a very high pressure. In another embodiment, the tree 12 may be a frac tree. For example, the valves 24 and 28 may be rated up to 10,000 psi to withstand the pressures generated during fracing. Once the well is fractured, production pressures may be less than 5,000 psi. However, due to the brief higher pressure rating requirement, all of the valves exposed to frac pressures may be rated up to 10,000 psi. This higher pressure rating makes the production equipment considerably more expensive to purchase and maintain. Accordingly, in accordance with embodiments of the present technique, a frac adapter 40, illustrated in FIG. 2, may be employed during the fracing process. In the context of the present disclosure, "frac adapter" may be defined as an apparatus which couples a frac tree to a wellhead then is removed prior to production. This is in contrast to a frac mandrel, which may be inserted into the tubing head 14 to seal off the lower pressure-rated valves 28 during fracing. That is, rather than merely blocking the lower pressure-rated valves 28 of the tubing head 14 as a frac mandrel may, the frac adapter 40 may completely replace the tubing head 14 during fracing. The tubing head 14 used during well production may then be rated for production pressures rather than the much higher frac pressures.

Figure 2:
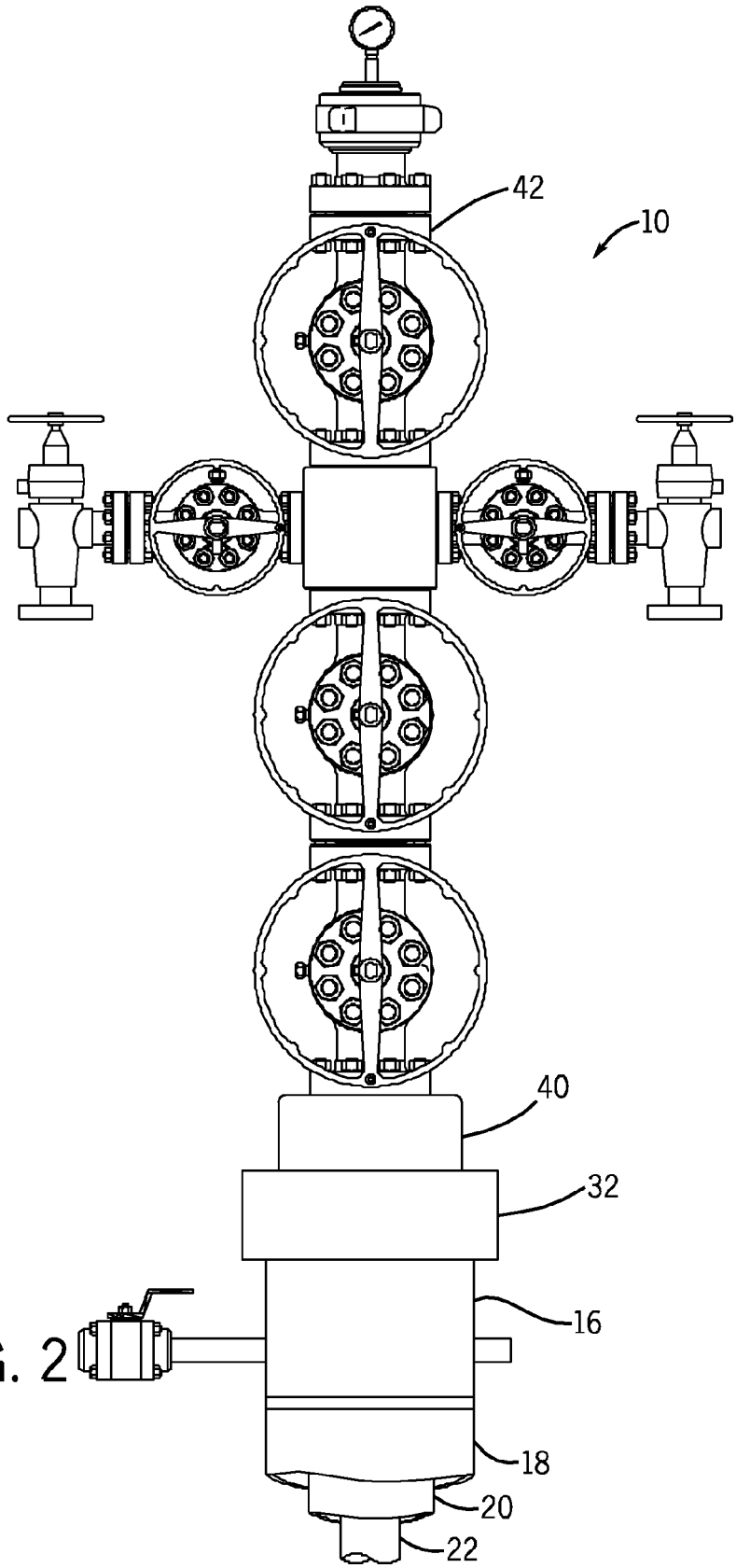
FIG. 2 is a side view of the wellhead of FIG. 1 having a frac tree attached thereto.

FIG. 2 illustrates an exemplary embodiment of the frac adapter 40 on the wellhead assembly 10. The adapter 40 is illustrated coupled to the casing head 16 via the union-nut coupling 32, however any suitable coupling system/device may be employed. A frac tree 42 is secured to the frac adapter 40 to control the flow of fracturing fluids. The frac adapter 40 operates to couple the frac tree 42 to the casing head 16. Accordingly, the frac adapter 40 may be disposed axially between the frac tree 42 and the casing head 16 rather than merely being placed inside another component of the wellhead assembly 10. As will be described, the frac adapter 40 may be secured to the casing head 16 before the tubing head 14 (FIG. 1) is installed. The well may be fractured without the tubing head 14 present, thereby eliminating the need for fracture-pressure equipment on the tubing head 14. The frac adapter 40 and the frac tree 42 may then be removed, and wellhead installation may proceed as normal. In some embodiments, the frac adapter 40 may be coupled to or integral with the frac tree 42 such that the adapter 40 remains with the tree 42, thereby reducing the time it takes to assemble the wellhead 10 for fracing.

Figure 3:
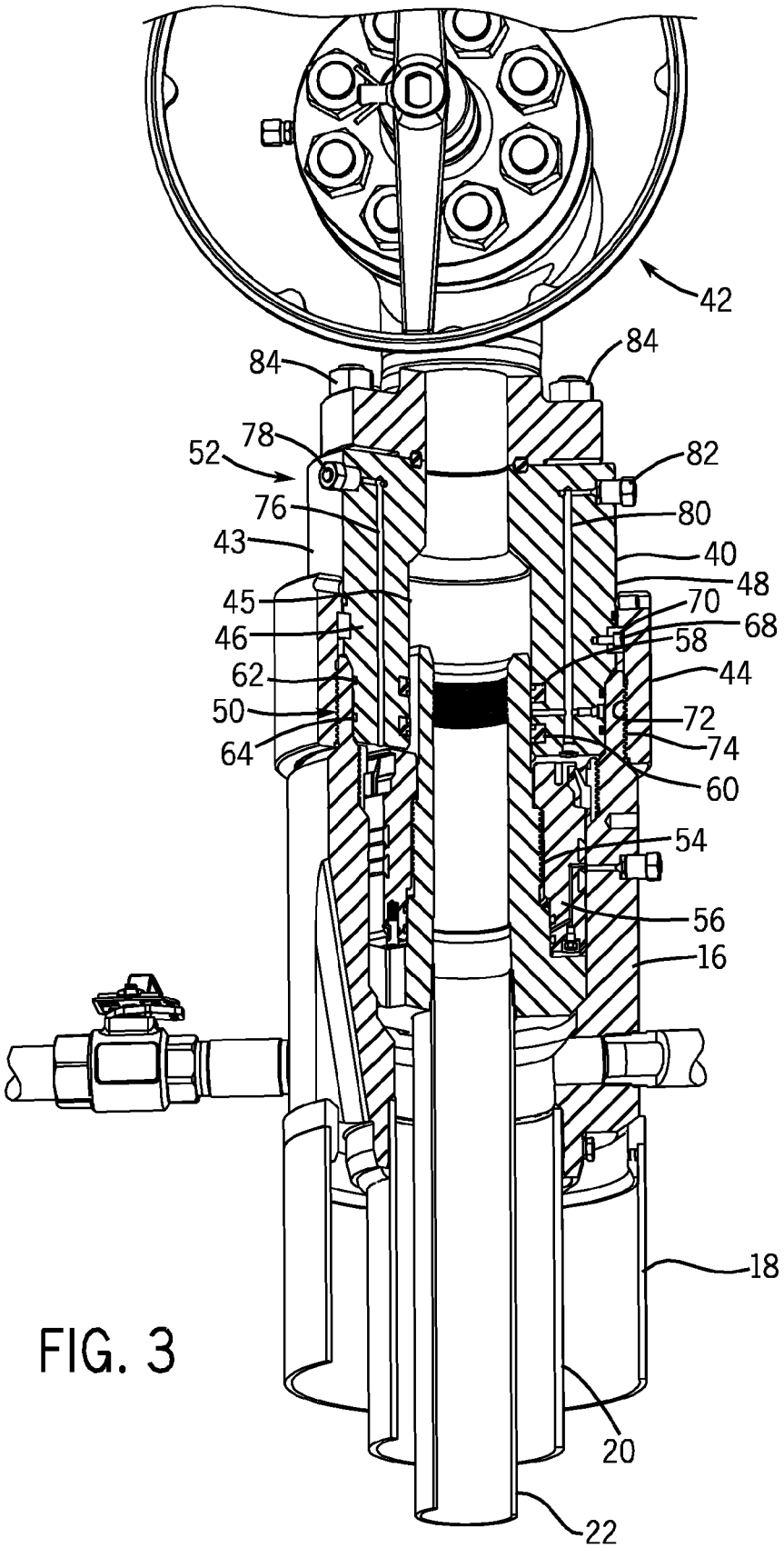
FIG. 3 is a partial cut-away view of an exemplary embodiment of a frac adapter coupled to a wellhead and frac tree.

FIG. 3 is a partial cut-away view of a wellhead having an exemplary embodiment of the frac adapter 40 coupled thereto. The exemplary frac adapter 40 is coupled to the casing head 16, for example, via the union-nut coupling 32. The exemplary frac adapter 40 may include a generally cylindrical body 43 and a coupling device 44, described below. A bore 45 through the body 43 enables the flow of fluids therethrough. A wall 46 may be defined between the bore 45 and an exterior 48 of the body 43. As discussed above, the fracturing fluid may be at a very high pressure, for example, up to 10,000 or 20,000 psi. Accordingly, the frac adapter 40 is constructed to withstand such high pressures. For example, the wall 46 may be relatively thick in relation to the bore 45 and/or to the adapter 40 overall.

The frac adapter 40 may generally include a casing connection end 50 and a tree connection end 52. The casing connection end 50 is part of the union-nut coupling 32 and is configured to form air-tight seals with the casing head 16 and a casing hanger 54 disposed within the casing head 16. The casing hanger 54 may be secured to the casing head 16 via a sealing ring 56. The casing connection end 50 of the frac adapter 40 may include seals 58 and 60 disposed in the bore 45 to provide an air-tight seal between the frac adapter 40 and the casing hanger 54 when the frac adapter 40 is coupled to the casing head 16. For example, the seals 58 and 60 may be ring seals, elastomer seals, metal seals, and so forth.

In addition, the casing connection end 50 may have seals 62 and 64 disposed about the exterior 48 of the body 43 to provide an air-tight seal between the adapter 40 and the casing head 16 while the components are coupled together. The coupling device 44 may be securable to the casing connection end 50 of the frac adapter 40 and to the casing head 16 to hold the components together. In the illustrated embodiment, the coupling device 44 is a union nut rotatably secured to the frac adapter 40, for example, via a protrusion 68 from the exterior 48. The protrusion 68 may be a removable device, such as a split ring, or may be a machined element of the adapter 40. A shoulder 70 on the coupling device 44 may axially abut the protrusion 68, thereby blocking removal of the coupling device 44 from the frac adapter 40. The coupling device 44 may also include threads 72 which correspond to mating threads 74 on the casing head 16. Accordingly, the coupling device 44 may be screwed onto the casing head 16 until the shoulder 70 abuts the protrusion 68, at which point the frac adapter 40 and the casing head 16 are secured together.

The union-nut coupling 32 may therefore include the coupling device 44, the casing connection end 50 of the frac adapter 40, and the mating threads 74 on the casing head 16. The coupling 32 may enable a simple make-up process that is vastly quicker than a traditional flange connector. That is, rather than securing a plurality of bolts and nuts as with a flange connector, the coupling device 44 is pre-attached to the frac adapter 40 and is merely threaded onto the casing head 16.

In addition, as discussed above, the seals 58, 60, 62, and 64 may ensure that fluids do not escape through the union-nut coupling 32. The seals 58, 60, 62, and 64 may be pressure-tested after the frac adapter 40 has been coupled to the casing head 16 to ensure that the seals are adequate. For example, a hole 76 through the wall 46 of the frac adapter 40 may enable pressure testing of the seals 60 and 64. That is, a plug 78 on the exterior 48 of the frac adapter 40 may be removed to expose the hole 76, and pressure may be applied therethrough. Similarly, a hole 80 may enable pressure testing of the seals 58 and 60. A plug 82 on the exterior 48 of the frac adapter 40 may be removed to allow access to the hole 80, which is routed to the casing hanger 54 between the seals 58 and 60. Accordingly, the seals 58, 60, 62, and 64 which ensure that the union-nut coupling 32 is air-tight may be tested after the frac adapter 40 is coupled to the casing head 16 and before the fracturing procedure is begun. The frac tree 42 may be coupled to the tree connection end 52 of the frac adapter 40, for example, via a plurality of fasteners 84, such as threaded bolts. In another embodiment, the frac adapter 40 may be integral with the frac tree 42. That is, the frac tree 42 may couple directly to the casing head 16 as described above with reference to the frac adapter 40)

Figure 4:
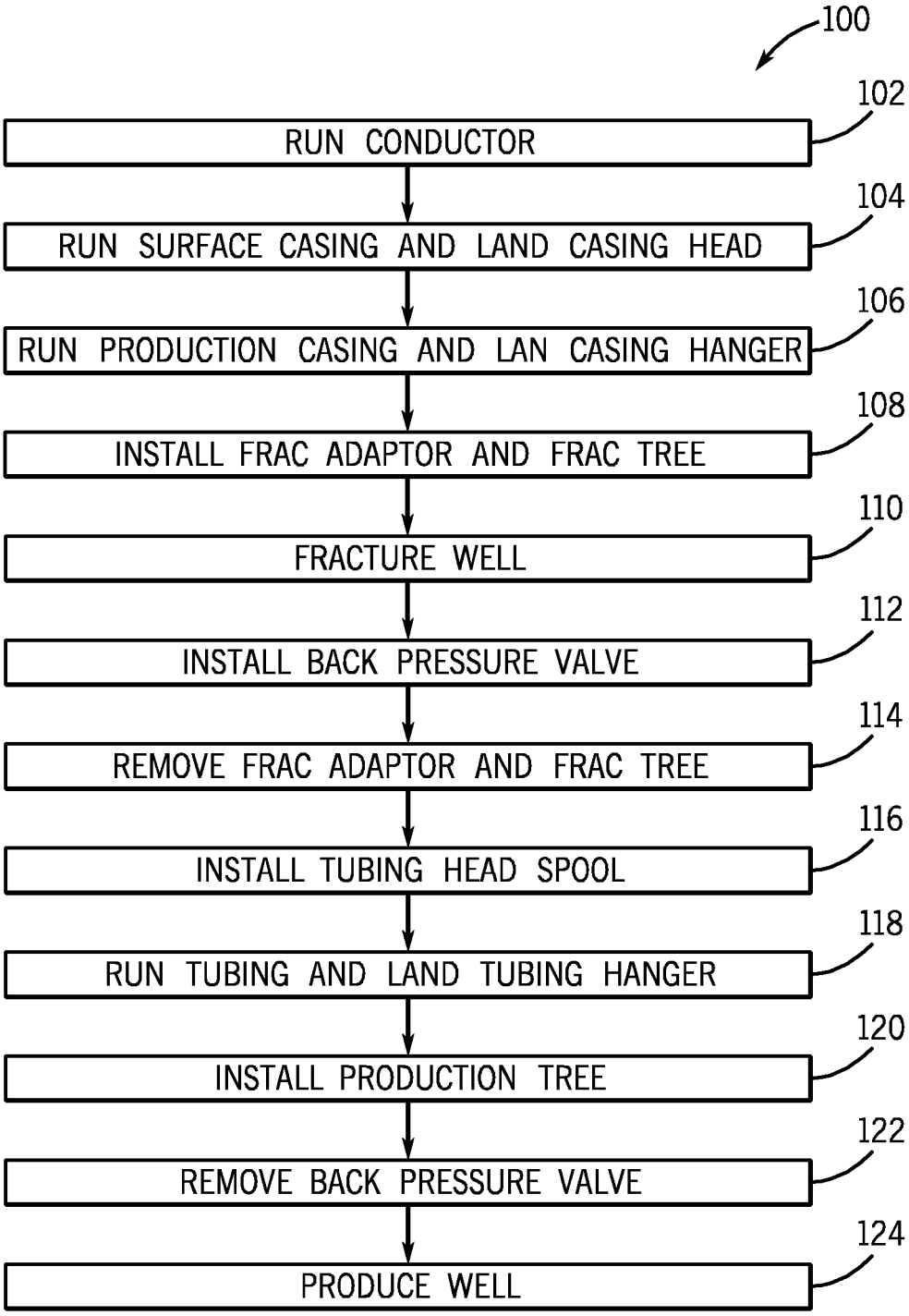
FIG. 4 is a flow chart of a process for using the wellhead of FIGS. 1-3.

FIG. 4 is a flow chart illustrating an exemplary embodiment of a process 100 for well production using a frac adapter, such as the exemplary adapter 40 described with respect to FIGS. 2 and 3. The process 100 may include installation of elements referred to in FIGS. 1-3. Additional or other steps may be implemented in the process 100, which begins with running the conductor pipe 18 from the surface to the mineral deposit (block 102). In some embodiments, the conductor pipe 18 may be cemented in place. The surface casing 20 may then be run into the conductor pipe 18 and the casing head 16 may be landed (block 104). The production casing 22 may be run into the surface 20, and the casing hanger 54 may be secured to the casing head 16 (block 106). For example, the sealing ring 56 may securely couple the casing hanger 54 within the casing head 16 such that axial movement of the casing hanger 54 with respect to the casing head 16 is blocked.

Before installing the tubing head 14, the frac adapter 40 and the frac tree 42 may be installed on the wellhead assembly 10 (block 108). As described above, the frac adapter 40 may be coupled to the casing head 16, and the frac tree 42 may be coupled to or integral with the frac adapter 40. The coupling 32 is optionally pressure-tested as described above. The well may then be fractured (block 110). That is, fracturing fluid may be pumped into the well at a very high pressure via the frac tree 12. In some embodiments, the frac pressure may be 10,000 psi, 20,000 psi, or even greater. The high-pressure fluids crack the rocks in the formation, thereby enabling the mineral deposits to flow through the formation more easily. Once the well has been fractured, a back pressure valve may be installed, for example, in the casing hanger 54 (block 112).

The frac adapter 40 and the frac tree 42 may then be removed from the wellhead assembly 10 (block 114), and the tubing head 14 may be installed (block 116). Because the well has already been fractured (block 110), the tubing head 14 may be selected based on the production pressures to which it will be subjected. These production pressures are likely to be much less than the frac pressure (e.g., up to 5,000 psi as compared to 10,000 psi), and therefore the tubing head 14 may have a much lower pressure rating than would be required if the head 14 were included in the fracturing process.

Tubing may then be run into the production casing 22 and a tubing hanger may be secured within the tubing head 14 to support the tubing (block 118). The tubing may, for example, carry fluids to the mineral deposit to augment the removal of minerals through the production casing 22. The production tree 12 may be installed onto the tubing head 14, as illustrated in FIG. 1 (block 120). The back pressure valve inserted before removal of the frac adapter 40 and tree 42 may then be removed, for example, through the inlet 26 on the tree 12 (block 122). Well production may then proceed (block 124).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method, comprising:

coupling a frac adapter directly to a casing head in place of a tubing head;

coupling a frac tree directly to the frac adapter;

coupling the frac adapter to a casing hanger;

advancing fracturing fluid through the frac tree, the frac adapter, and the casing head; and removing the frac adapter and the frac tree from the casing head.

2. The method of claim 1, comprising sealing the frac adapter to the casing head with a first seal and sealing the frac adapter to the casing hanger with a second seal.

3. The method of claim 1, comprising installing a back pressure valve in the casing hanger prior to removing the frac adapter and the frac tree.

4. The method of claim 1, comprising installing the tubing head on the casing head after removing the frac adapter and the frac tree.

5. The method of claim 1, comprising pressure-testing seals between the frac adapter and the casing head before advancing the fracturing fluid therethrough.

6. The method of claim 1, wherein the frac adapter is disposed directly axially between the casing head and the frac tree.

7. The method of claim 1, comprising extracting minerals after removing the frac adapter and the frac tree from the casing head.

8. The method of claim 1, wherein removing the frac adapter and the frac tree comprises concurrently removing the frac adapter and the frac tree from the casing head.

9. The method of claim 1, wherein the frac adapter is integral with the frac tree.

10. The method of claim 1, wherein the frac adapter comprises a coupling device having a union nut.

11. The method of claim 1, wherein the frac adapter comprises:

a tubular body extending axially between the frac tree and the casing head;

a coupling device coupled to the tubular body, wherein the coupling device secures the frac adapter to an exterior of the casing head, and the coupling device comprises a union nut;

a bore extending through the tubular body, wherein the bore receives the casing hanger coupled to the casing head;

a first seal disposed about an outer circumference of the frac adapter, wherein the first seal provides sealing between the frac adapter and the casing head;

a second seal disposed within the bore along an inner circumference of the frac adapter, wherein the second seal provides sealing between the frac adapter and the casing hanger.

12. The method of claim 11, comprising a plurality of first seals disposed about the outer circumference of the frac adapter and configured to seal the frac adapter to the casing head.

13. The method of claim 12, wherein the frac adapter comprises at least one pressure test port configured to enable pressure testing of the plurality of first seals.

14. The method of claim 11, comprising a plurality of second seals disposed within the bore along the inner circumference of the frac adapter and configured to seal the frac adapter and the casing hanger.

* * * * *